US005865630A

United States Patent [19]

Nakano

[11] Patent Number: 5,865,630

[45] Date of Patent: Feb. 2, 1999

[54] CONNECTION PIN

[75] Inventor: Azuma Nakano, Tokyo, Japan

[73] Assignee: Oki Electric Industry Co., Ltd., Tokyo, Japan

[21] Appl. No.: 978,482

[22] Filed: Nov. 25, 1997

[30] Foreign Application Priority Data

Apr. 21, 1997 [JP] Japan ..... 9-103139

[51] Int. Cl.[6] ..... H01R 13/00; H01R 4/00

[52] U.S. Cl. ..... 439/48

[58] Field of Search ..... 439/45, 46, 47, 439/48, 265, 825; 361/633, 634, 635, 636

[56] References Cited

U.S. PATENT DOCUMENTS

| | | | |
|---|---|---|---|
| 3,394,341 | 7/1968 | Venn | 439/825 |
| 4,405,195 | 9/1983 | Cherry et al. | 439/825 |
| 5,266,052 | 11/1993 | Phillips, II | 439/562 |

OTHER PUBLICATIONS

H.C. Schick, Inter–Board Connections, IBM Disclosure Bulletin, vol. 7, No. 6, p. 515, Nov. 1964.

H.P. Byrnes, Force of Deflection Amplification Contact, IBM Disclosure Bulletin, vol. 8, No. 6, p. 838, Nov. 1965.

H. Fukuda, K. Ishikawa, H. Takayama, and T. Oda, "Smart MDF", Oki Electric Industry Research & Development, No. 170, Apr. 1, 1996, pp. 81–84.

*Primary Examiner*—Edgar Burr
*Assistant Examiner*—Amanda B. Sandusky
*Attorney, Agent, or Firm*—Wenderoth, Lind & Ponack, L.L.P.

[57] ABSTRACT

A connection pin is used to electrically connect a first pattern and a corresponding second pattern of at least one set of patterns formed in a matrix board and crossing one over the other. The connection pin is inserted into a through-hole formed in the matrix board. The through-hole extends through the first and second patterns at an intersection of the first and second patterns. The connection pin includes a fitting portion, abutting portion, and electrical conductor between the fitting portion and abutting portion. The conductor generally extends along the through-hole and has a pair of resiliently deformable ends. One deformable end is mounted to the fitting portion and the other deformable end is mounted to the abutting portion. When the connection pin is inserted into the through-hole, the abutting portion abuts the extreme end of the through-hole. A further insertion of the connection pin causes the fitting and abutting portions to move toward each other. This causes the conductor to resiliently deform so that the conductor laterally extends into electrical contact with the first and second patterns. The connection pin may include a plurality of conductors with an insulating material between adjacent conductors in order to accomplish electrical connection between the first and second patterns of a plurality of sets of patterns.

6 Claims, 6 Drawing Sheets

CONNECTION PIN

BACKGROUND OF THE INVENTION

1. Field of the Invention

The present invention relates to a connection pin and more particularly to a connection pin for use with a main distributing frame (referred to as MDF hereinafter).

2. Description of Related Art

An automatic MDF apparatus is an apparatus which is provided between subscribers and the switching system and automatically performs the installation, move, and removal of a telephone line. The automatic MDF apparatus includes a matrix board which accommodates a plurality of lines on the subscriber side and a plurality of lines on the switching system side, connection pins which are inserted into the through-holes in the matrix board to connect between the subscriber's lines and the switching system's lines, and a robot which manipulates the connection pins.

The matrix board has a layer of parallel pattern traces on the subscriber side and a layer of parallel pattern traces on the switching system side, the layers being in different parallel planes, insulated from each other. The layers are arranged so that the parallel pattern traces of one layer are perpendicular to those of the other. The through-holes are formed which extend through the pattern traces of the two layers at the intersections of the pattern traces.

The through-holes are not electrically conductive and therefore the patterns on the subscriber side are electrically isolated from those on the switching system side. Upon insertion of the connection pin having an electrical conductor or conductors into the through-hole, the conductor of the connection pin establishes electrical connection between the subscriber's pattern trace and the switching system's pattern trace, thereby making a line connection between the subscriber's line and the switching system's line.

A telephone line requires a pair of lines, i.e., a sending line and a receiving line. Thus, the matrix board includes four layers of patterns, i.e., a pair of wires for subscriber side and a pair of wires for the switching system side. The connection pin includes a pair of conductors so that an insertion of the connection pin makes a pair of connections simultaneously. A prior art connection pin is made of a resilient and electrically conductive material and has a diameter slightly larger than that of the through-hole in the matrix board. The prior art connection pin is press-fitted into the through-hole so that the connection pin is in pressure contact with the through-hole.

More specifically, the connection pin is a hollow cylinder with a longitudinal slit, formed therein. The connection pin has a diameter slightly larger than that of the through-hole. When the connection pin is forcibly inserted into the through-hole, the connection pin is resiliently deformed in such a way that the slit becomes narrower. This deformation of the connection pin allows the outer diameter of the connection pin to be adjusted to the inner diameter of the through-hole.

Another example of a connection pin includes a conductor in the form of wire springs having resilience and electrical conductivity. The wire springs are mounted to the connection pin to extend outwardly thereof so that the spring-to-spring distance is slightly longer than the inner diameter of the through-hole. As the connection pin is inserted into the through-hole, the springs are deformed toward each other due to pressures exerted by the inner wall of the through-hole so that the connection pin moves into pressure contact with the through-hole.

Recently, high density package and miniaturization of the switching system have become increasing necessary, and therefore such necessity has placed demands on the miniaturization of connection pins. However, the aforementioned prior art connection pin does not lend itself to miniaturization since the prior art connection pin is difficult to manufacture if it is to be miniaturized.

For example, the hollow cylinder type connection pin having a slit formed therein is manufactured by folding a metal sheet. It is difficult to shape the material into a hollow cylinder with a uniform width of slit, therefore it is difficult to provide a desired contact pressure against the inner wall of the through-hole. A poorly bent cylinder can cause the conductor to be caught by the matrix board when inserted into the through-hole, leading to damages and troubles of connection.

The wire spring type connection pins are also difficult to manufacture and can result in damages and troubles when the connection pins are inserted into or pulled out of the through-hole.

SUMMARY OF THE INVENTION

An object of the invention is to provide miniaturized connection pins for connecting a line on a subscriber side and a line on a switching system side.

At least one set of patterns is formed in a matrix board for telephone switching and a first pattern and a corresponding second pattern of the set extend to cross one over the other. A through-hole is formed to extend through the first and second patterns at an intersection of the first and second patterns. A connection pin is used to electrically connect the first pattern, and the corresponding second pattern of at least one set of patterns. The connection pin is inserted into the through-hole formed in the matrix board. The connection pin includes a fitting portion, abutting portion, and electrical conductor between the fitting portion and abutting portion. The conductor generally extends longitudinally and has a pair of resiliently deformable ends. One deformable end is mounted to the fitting portion and the other deformable end is mounted to the abutting portion. When the connection pin is inserted into the through-hole, the abutting portion abuts the extreme end of the through-hole. A further insertion of the connection pin causes the fitting and abutting portions to move toward each other, causing the conductor to resiliently deform so that the conductor laterally extends into electrical contact with the first and second patterns. The matrix board may be formed a plurality of sets of patterns for accommodating a plurality of telephone lines. Correspondingly, the connection pin may include a plurality of conductors with an insulating material between adjacent conductors in order to accomplish electrical connection between the first pattern and second pattern of each pair of a plurality of sets of patterns.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The present invention will be described in detail with reference to the accompanying drawings.

FIRST EMBODIMENT

Figure 1:
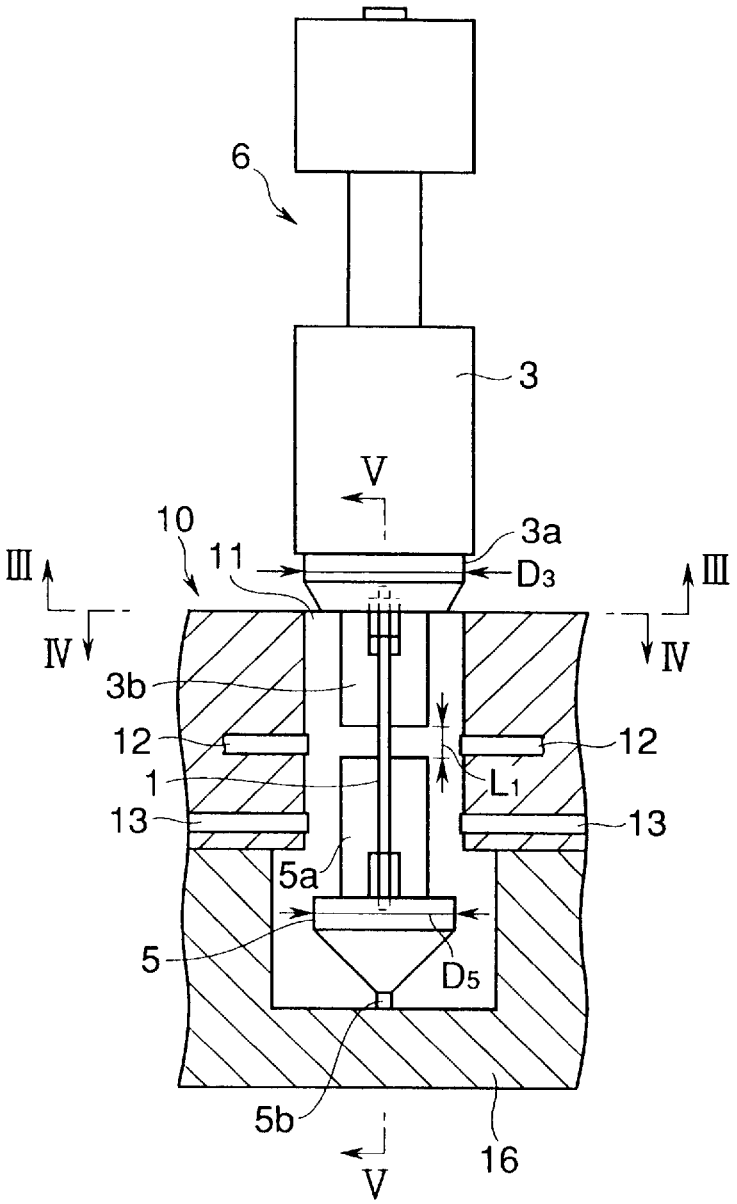
FIG. 1 is a partially cross-sectional side view of a connection pin according to a first embodiment.
Figure 3:
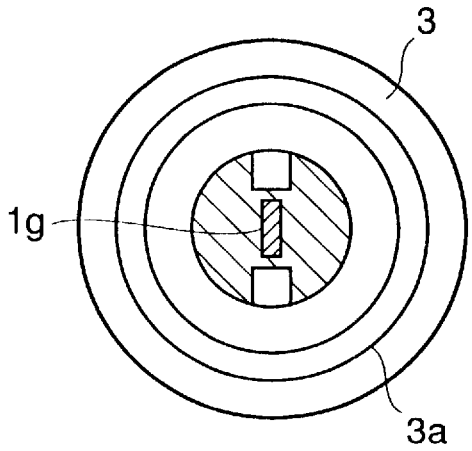
FIG. 3 is a cross-sectional view taken along lines III—III of FIG. 1.
Figure 4:
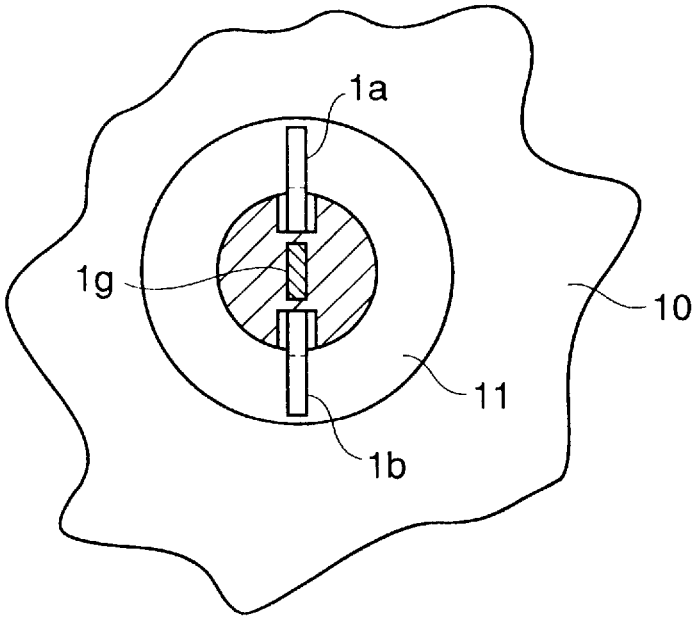
FIG. 4 is a cross-sectional view taken along lines IV—IV of FIG. 1.

FIG. 1 is a partially cross-sectional side view of a connection pin 6 of a basic form. FIG. 3 is a cross-sectional view taken along lines III—III of FIG. 1 and FIG. 4 is a cross-sectional view taken along lines IV—IV of FIG. 1.

Referring to FIG. 1, a connection pin 6 includes an upper mold 3, lower mold 5, and a loop-like conductor 1 (FIG. 2) between the upper mold 3 and lower mold 5.

The connector 6 is inserted into a through-hole 11 of a matrix board 10 to make electrical connection between pattern traces on the subscriber side and pattern traces on the switching system side via the conductor 1.

As described later in detail with reference to FIGS. 3 and 4, the electrical connection is made when the generally loop-shaped conductor 1 is deformed so that the conductor 1 becomes in contact with a subscriber's line in an X-pattern 12 to a switching system's Line in a Y-pattern 13 extending perpendicular to the X-pattern 12. The X- and Y-pattern will be described later in detail.

While the basic form of the connection pin 6 has only one conductor 1, many more conductors may be used in accordance with the number of pattern traces in the matrix board 10.

Figure 2:
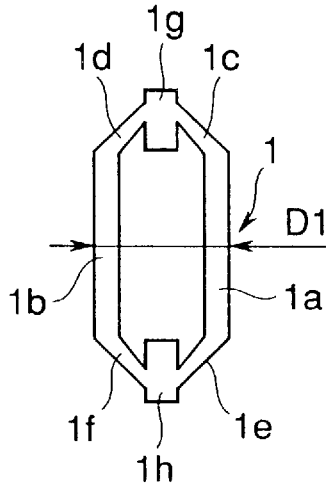
FIG. 2 illustrates a conductor for use in the connection pin.

FIG. 2 shows the conductor 1. The conductor 1 may be readily made from a sheet metal material by stamping process at low cost. The upper mold 3 of the connection pin 6 is insert-molded with in upper end portion 1*g* of the conductor 1 to securely hold tile upper end portion 1*g*. When molding the lower mold 5, a lower end portion 1*h* of the conductor 1 is included as an insert and is firmly held by the lower mold 5. The upper and lower end portions 1*g* and 1*h* of the conductor 1 are so shaped that the conductor 1 is securely held in the upper and lower molds 3 and 5 when the conductor 1 is insert-molded. The conductor 1 is of a generally loop-like shape with both lateral sides 1*a*–1*b* vertically extending straight. The lateral sides 1*a*–1*b* are continuous with upper and lower ends 1*g* and 1*h* via obliquely extending narrow parts 1*c*–1*f*. When the connection pin 6 is pressed vertically into the through-hole 11, the narrow parts 1*c*–1*f* are deformed in such a way that the lateral sides 1*a*–1*b* extend laterally away from each other into pressure contact with the pattern traces in the X- and Y-patterns 12 and 13, respectively. The straight lateral sides 1*a*–1*b* are advantageous in that they ensure good electrical contact with the pattern traces when the lateral sides 1*a*–1*b* laterally displace into pressure contact with the walls of the through-hole 11.

The connection pin 6 is handled by a robot, not shown, which inserts the connection pin 6 into a desired through-hole 11 in the matrix board 10. The robot grasps the connection pin 6 at the upper mold 3 when inserting the connection pin 6 into a through-hole 11. The upper mold 3 has a fitting portion 3*a* at its lower end. The fitting portion 3*a* securely fits into the through-hole 11 and is therefore configured to the shape of the through-hole 11. For example, if the through-hole 11 has a circular opening, the fitting portion 3*a* is also made to have a circular cross section. The diameter D3 of the fitting portion 3*a* is made slightly larger than the inner diameter of the through-hole 11 so that the fitting portion 3*a* may be press-fitted into the through-hole 14 for secure engagement.

The lower mold 5 has a diameter D5, which is slightly smaller than the diameter D3 of the fitting portion 3*a*, so that, the lower mold 5 can smoothly enter the through-hole 11 with a predetermined clearance between the inner wall of the through-hole 11. The conductor 1 has a dimension D1 smaller than the diameter D5 of the lower mold 5.

The upper mold 3 and the lower mold 5 are positioned relative to each other so that stoppers 3*b* and 5*a* are spaced apart by a predetermined distance L1.

The lower mold 5 has an abutting portion 5*b* formed at its lower end. When the connection pin 6 is inserted into the through-hole 11, the abutting portion 5*b* abuts a later described closing plate 16 at an extreme end of the through-hole 11.

Figure 5:
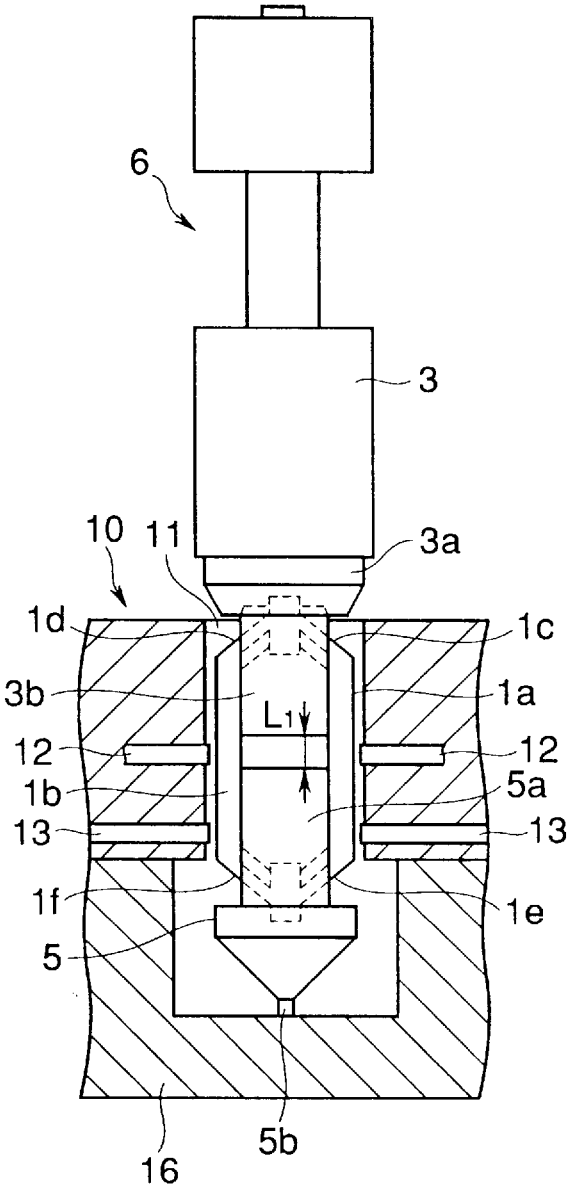
FIG. 5 is a partially cross-sectional view taken along lines V—V of FIG. 1 immediately after the abutting portion abuts the closing plate.
Figure 6:
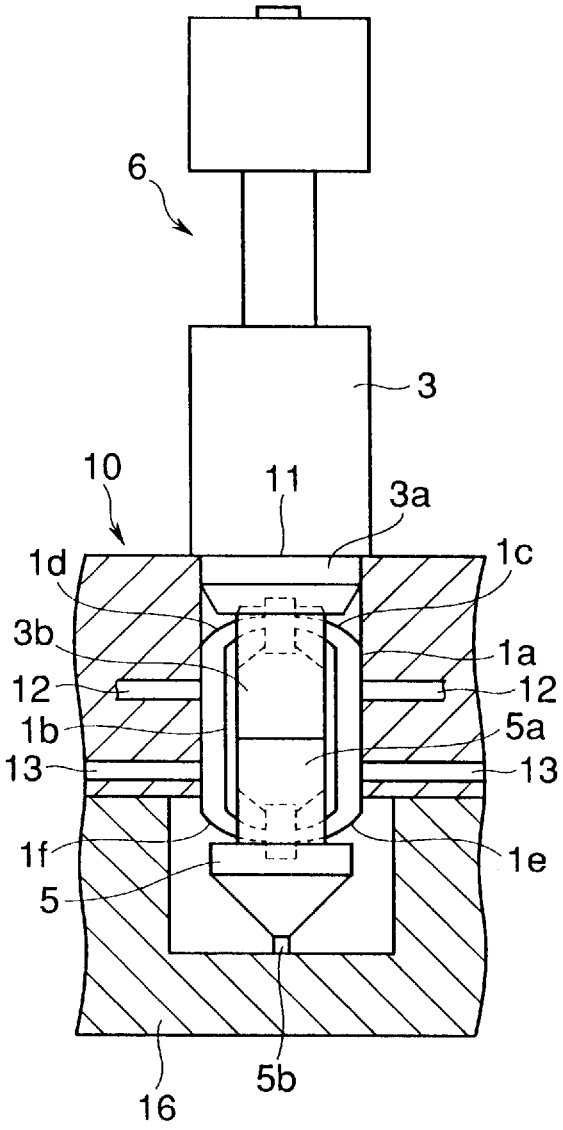
FIG. 6 is a partially cross-sectional view of FIG. 1 when the connection pin shown in FIG. 5 has been fully inserted into the through-hole and fixedly held in position.

FIG. 5 is a partially cross-sectional side view taken along lines V—V of FIG. 1, showing the connection pin 6 immediately after the abutting portion 5*b* abuts the closing plate 16. FIG. 6 is a partially cross-sectional side view of FIG. 1, showing the connection pin 6 shown in FIG. 5 which has been fully inserted into the through-hole 11 and fixedly held in position.

Referring to FIGS. 5 and 6, a matrix board 10 is used in, for example, an automatic MDF apparatus. The matrix board 10 includes the X-pattern 12 in which a plurality of wires on the subscriber side are arranged in parallel with each other, and the Y-pattern 13 in which a plurality of wires on the switching system side are arranged in parallel with each other. The X-pattern 12 and Y-pattern 13 are in different planes and are arranged so that, the wires extend perpendicular to each other, a through-hole it being formed at each crossing point. The X-pattern 12 and Y-pattern 13 are electrically isolated from each other.

Connecting a wire or pattern trace in the X-pattern 12 to a wire or pattern trace in the Y-pattern 13 in a later described manner establishes a line connection between a subscriber's line assigned to the wire of the X-pattern 12 and a switching system's line assigned to the Y-pattern 13.

The closing plate 16 is located at the extreme end of the through-hole 11 and closes the through-hole 11. When a new subscriber is to be connected to the switching system, a through-hole 11 is first determined at which a wire of the X-pattern 12 assigned to the new subscriber crosses a corresponding wire of the Y-pattern 13 connected to the switching system. Then, the robot is operated to insert the connection pin 6 into the through-hole it, thereby electrically connecting the wire of the X-pattern 12 with the wire of the Y-pattern 13 via the connection pin 6 to establish a telephone line for the new subscriber.

Only a very small amount of force is required to smoothly insert the connection pin 6 into the through-hole 11 since the diameter D5 of the lower mold 5 is smaller than that of the through-hole 11 and the widths D1 of the conductor 1 is smaller than the diameter D5. This dimensional relation eliminates the possibility of the connection pin 6 being caught in the through-hole 11.

When the connection pin 6 is inserted into the through-hole 11, the abutting portion 5*b* abuts the closing plate 16 as shown in FIG. 5.

If the connection pin 6 is further inserted into the through-hole 11, a compressive force vertically exerted on the conductor 1 causes the narrow parts 1*c*–1*f* to deform as shown in FIG. 6 so that the vertically extending sides 1*a*–1*b* of the conductor 1 laterally extend into pressure contact with the inner wall of the through-hole 11.

As a result, the sides 1*a*–1*b* electrically contact the X-pattern 12 and Y-pattern 13, thereby electrically connecting the two patterns together.

If the connection pin 6 is still further inserted into the through-hole 11, the stoppers 3*b* and 5*a* are forced together so that the gaps between them are eliminated as shown in FIG. 6. When the stoppers 3*b* and 5*a* abut each other, the connection pin 6 cannot be inserted any further so that the sides 1*a*–1*b* will not laterally extend any further. The fitting portion 3*a* fits into the through-hole 11, the friction between the fitting portion 3*a* and the wall of the through-hole 11 preventing the pull out of fitting portion 3*a*.

The material and shape of the conductor 1 are selected so that the conductor 1 engages the X- and Y-patterns 12 and 13 with a reasonable pressure. A robot can be used to simply pull the connection pin 6 out of the through-hole 11, thereby disconnecting the line connection established by the connection pin 6. When the connection pin 6 in FIG. 6 is pulled out, the narrow parts 1*c*–1*f* regain their original shapes as shown in FIG. 5. Thus, the connection pin 6 can be smoothly pulled out without being caught by the inner wall of the through-hole 11.

SECOND EMBODIMENT

While the connection pin includes only one conductor 1 in the first embodiment, many more conductors may be used in accordance with the configuration of the matrix board 10.

Figure 7:
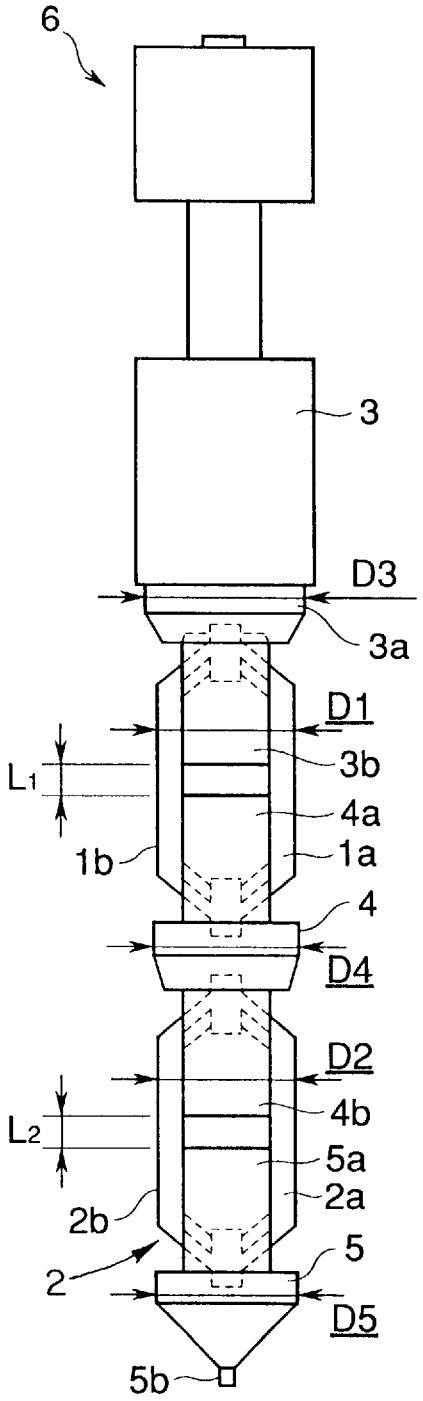
FIG. 7 illustrates a connection pin according to a second embodiment.

FIG. 7 illustrates a connection pin according to the second embodiment. Like elements have been given like numerals and description thereof is omitted.

Referring to FIG. 7, the connection pin 6 includes a pair of conductors which electrically connect a pair of subscriber's lines to a pair of switching system's lines. The pair of conductors includes a first conductor 1 and a second conductor 2. The conductors 1 and 2 are the same as the conductor in the first embodiment.

A connection pin 6 according to the second embodiment includes an upper mold 3, intermediate mold 4, and lower mold 5. The upper mold 3 is insert-molded with the upper end portion 1*g* of the first conductor 1 to securely hold the upper end portion 1*g*. When molding the intermediate mold 4, the lower end portion 1*h* of the first conductor 1 is included as an insert and is firmly held by the intermediate mold 4. When the lower mold 5 is molded, the conductor 2 is included as an insert and is securely held by the lower mold 5. The first conductor 1 and second conductor 2 are electrically isolated form each other.

The intermediate mold 4 and lower mold 5 have diameters D4 and D5, respectively, slightly smaller than the diameter D3 of the fitting portion 3*a* so that the lower mold 5 and intermediate mold 4 can smoothly enter the through-hole with a predetermined clearance between the inner wall of the through-hole. The conductor 1 and conductor 2 have smaller dimensions D1 and D2 than the diameters D4 and D5 of the intermediate mold 4 and lower mold 5, respectively. The dimensions D1 and D2 may preferably be of the same dimension.

The upper mold 3 and intermediate mold 4 are positioned relative to each other so that the lower portion 3*b* of the upper mold 3 arid the upper portion 4*a* of the intermediate mold 4 are spaced apart by a predetermined distance L1. Likewise, the intermediate mold 4 and lower mold 5 are positioned relative to each other so that, the lower portion 4*b* of the intermediate mold 4 and the upper portion 5*a* of the lower mold 5 are spaced apart by a predetermined distance L2. The distances L1 and L2 may preferably be of the same value.

The lower mold 5 has an abutting portion 5*b* formed at its lower end. When the connection pin 6 is inserted into the through-hole 11, the abutting portion 5*b* abuts the later described closing plate 16 at an extreme end of the through-hole 11.

Figure 8:
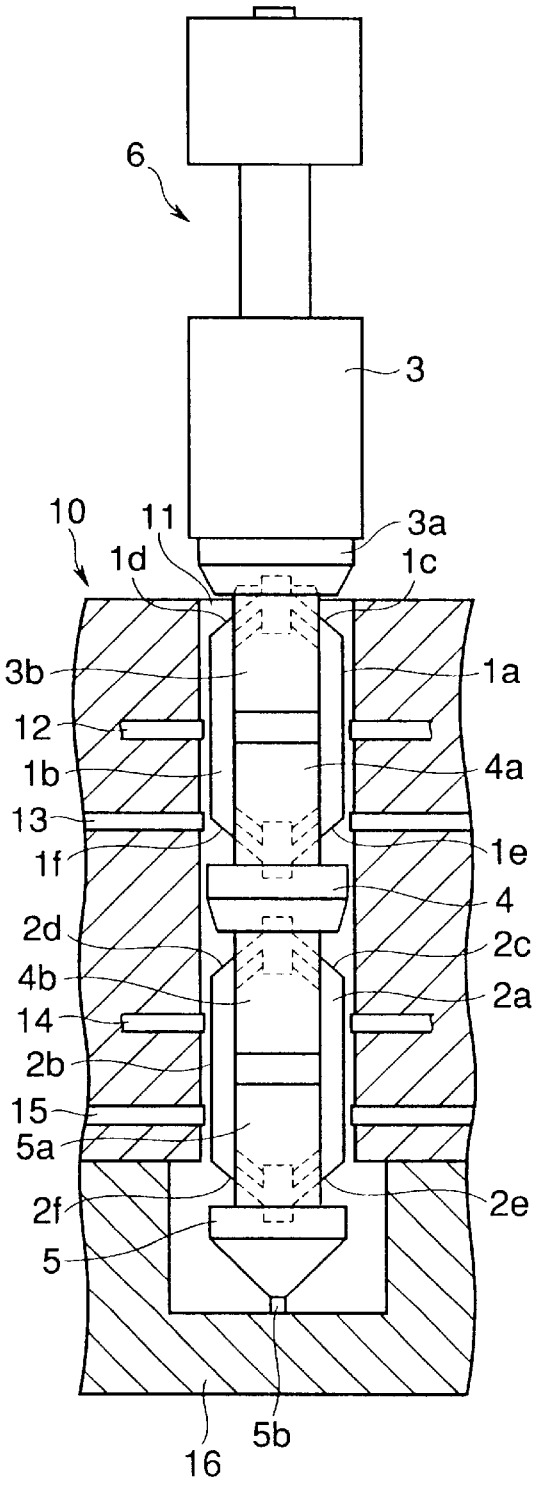
FIG. 8 illustrates the connection pin of the second embodiment immediately after the abutting portion abuts the closing plate.
Figure 9:
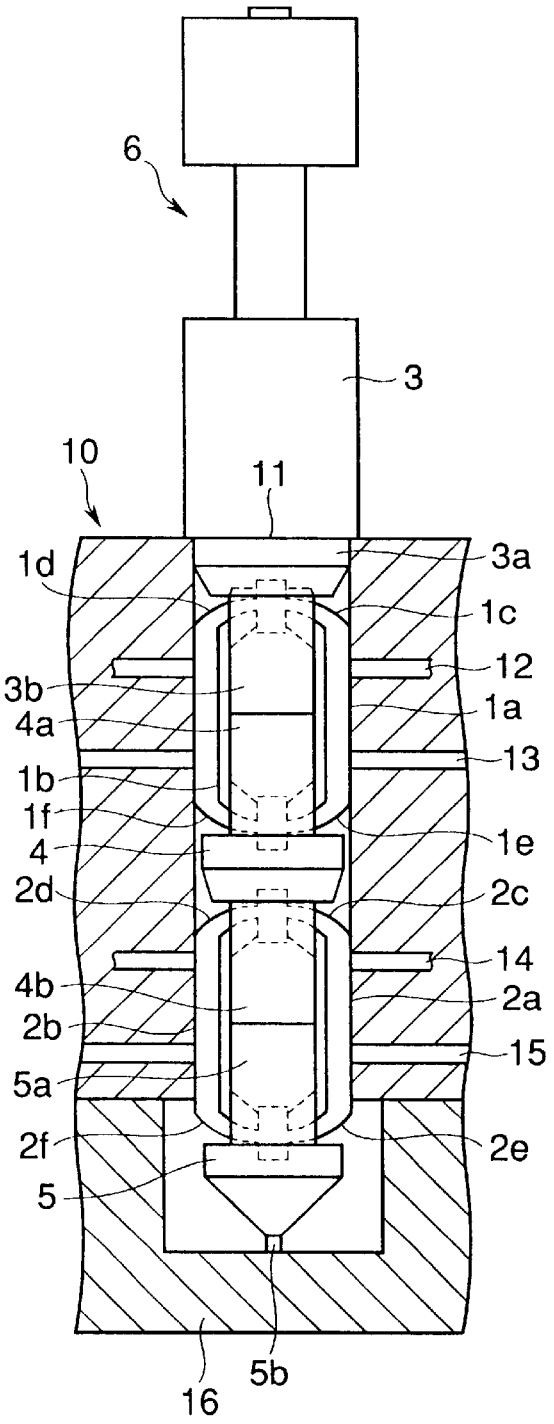
FIG. 9 illustrates the connection pin of the second embodiment after the connection pin has been fully inserted and fixedly held in position.

FIGS. 8 and 9 are partially cross-sectional side views illustrating the connection pin 6 when being inserted into the through-hole, FIG. 2A showing the connection pin 6 immediately after the abutting portion 5*b* abuts the closing plate 16 and FIG. 2B showing the connection pin 6 after the connection pin 6 has been fully inserted into the through-hole and fixedly held in position.

Referring to FIGS. 8 and 9, a matrix board 10 is used in, for example, an automatic MDF apparatus. The matrix board 10 includes an X-pattern 12 in which a plurality of wires on the subscriber side are arranged in parallel with each other, and a Y-pattern 13 in which a plurality of wires on the switching system side are arranged in parallel with each other. The X-pattern and Y-pattern are in different planes and are arranged so that the wires are perpendicular to each other, a through-hole 11 being formed at, each crossing point. The X-pattern and Y-pattern are electrically isolated from each other.

Connecting a wire of the X-pattern to a wire of the Y-pattern in a later described manner establishes a line connection between a subscriber's line assigned to the wire of the X-pattern and a switching system's line assigned to the Y-pattern.

To establish a complete telephone line, a receiver-transmitter pair is needed. Thus, the matrix board 10 preferably has a pair of wires on the subscriber side and a pair of wires on the switching system side. For this reason, another pair of X-pattern 14 and Y-pattern 15 are added to the matrix board 10.

The closing plate 16 is located at the extreme end of the through-hole 11 and closes the through-hole 11. When a new subscriber is to be connected to the switching system, a through-hole is determined which corresponds to a wire of the X-pattern 12 assigned to the new subscriber and a corresponding wire of the Y-pattern 13 connected to the switching system. Then, the robot is operated to insert the connection pin 6 into the through-hole, thereby electrically connecting the wire of the X-pattern with the wire of the Y-pattern via the connection pin for the new subscriber.

Only a very small amount of force is required to smoothly insert the connection pin 6 into the through-hole since the diameters D4 and D5 of the intermediate mold 4 and lower mold 5 are smaller than that of the through-hole and the widths D1 and D2 of the conductors 1 and 2 are smaller than the diameters D4 and D5. There is no possibility of the connection pin being caught in the through-hole.

When the connection pin 6 is inserted into the through-hole 11, the abutting portion 5*b* abuts the closing plate 16 as shown in FIG. 8.

If the connection pin 6 is further inserted into the through-hole 11, a compressive force vertically exerted on the conductors 1 and 2 causes the obliquely extending narrow parts 1*c*–1*f* and 2*c*–2*f* to deform as shown in FIG. 9 so that the vertically extending sides 1*a*–1*b* and 2*a*–2*b* of the conductors 1 and 2 are laterally extend into pressure contact with the inner wall of the through-hole 11.

As a result, the sides 1*a*–1*b* electrically contact the X-pattern 12 and Y-pattern 13, thereby electrically connecting the two patterns together. The sides 2*a*–2*b* electrically contact the X-pattern 14 and Y-pattern 15, thereby electrically connecting the two patterns together.

If the connection pin 6 is still further inserted into the through-hole 11, the stoppers 3*b*, 4*a*, 4*b*, and 5*a* are forced together so that the gaps between them are eliminated. When the stoppers 3*b*, 4*a*, 4*b*, and 5*a* are forced together, the connection pin 6 cannot be inserted any further so that the sides 1*a*–1*b* and 2*a*–2*b* will not extend any further. The fitting portion 3*a* fits into the through-hole 11 as shown in FIG. 6, the friction between the fitting portion 3*a* and the wail of the through-hole 11 preventing the pull out of the fitting portion 3*a*.

When the connection pin 6 in FIG. 9 has been pulled out, the narrow parts 1*c*–1*f* and 2*c*–2*f* regain their original shapes as shown in FIG. 7. Thus, the connection pin 6 can be smoothly pulled out without being caught by the inner wall of the through-hole 11.

THIRD EMBODIMENT

Figure 10:
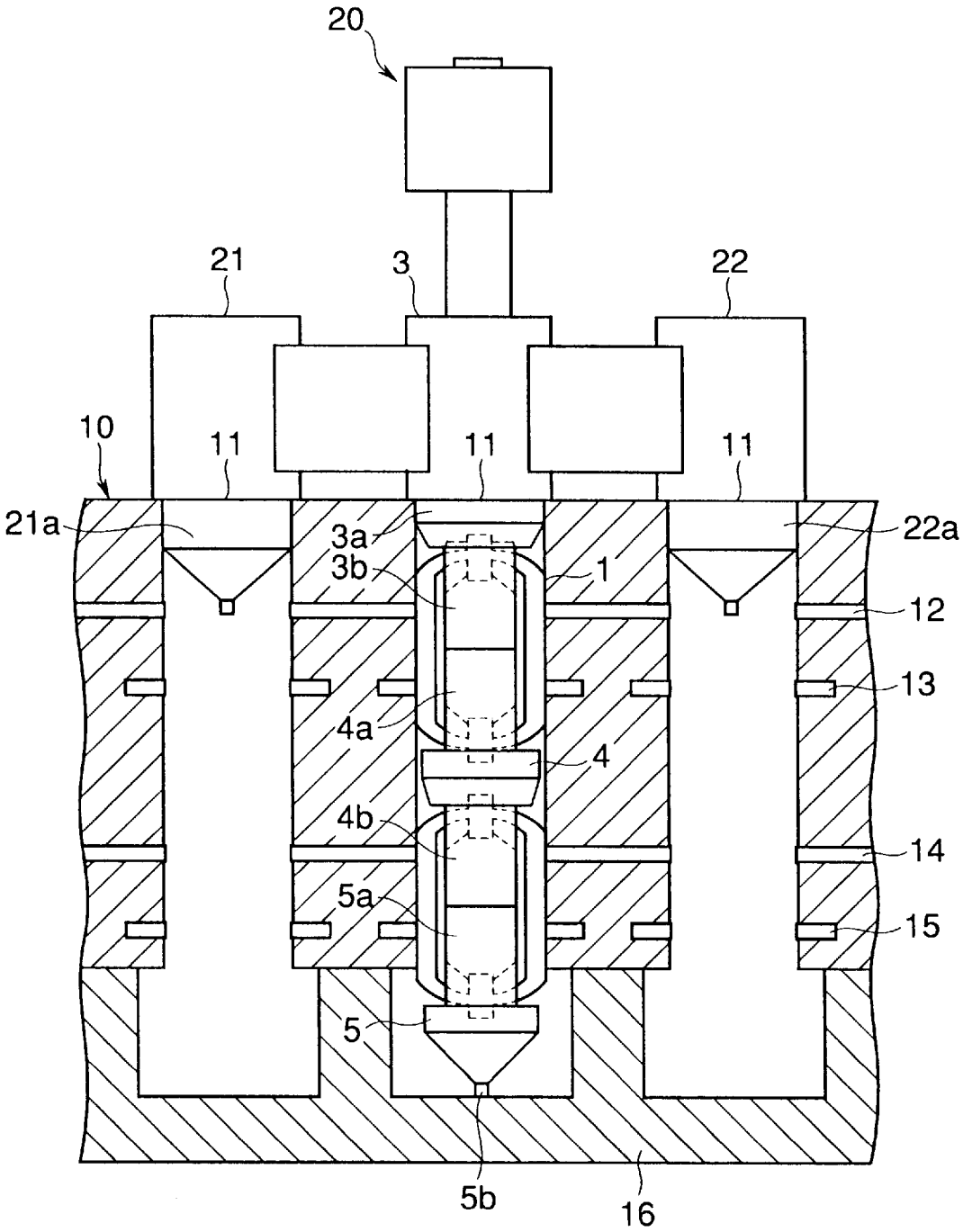
FIG. 10 illustrates the connection pin according to a third embodiment when it is inserted into the through-hole in the matrix board and held in position.

A third embodiment differs from the second embodiment in that the connection pin 6 is provided with an auxiliary support 21 and 22. FIG. 10 illustrates the connection pin 20 according to the third embodiment when the connection pin 20 is inserted into the through-hole 11 in the matrix board 10 and held in position.

Referring to FIG. 10, the auxiliary supports 21 and 22 are connected to the upper mold 3. The supports 21 and 22 may be formed in one piece construction with the upper mold 3. The auxiliary supports 21 and 22 have fitting portions 21*a* and 22*a* which are configured to the geometry of the through-hole 11 and firmly fit into the through-hole 11. For example, if the through-hole 11 has a round opening, then the fitting portions 21*a* and 22*a* are also formed to have a circular cross section and a diameter which provides a sufficient friction between the wall of the through-hole and the fitting portions 21*a* and 22*a* for secure support when fitted into the through-hole 11.

The through-holes 11 are arranged at predetermined intervals in the matrix board 10 and therefore the auxiliary supports 21 and 22 are arranged correspondingly so that the fitting portions 21*a* and 22*a* are in alignment with through-holes 11 adjacent to the through-hole 11 into which the connection pin 6 is inserted.

As shown in FIG. 10, the conductor 1 connects the X-pattern 12 to the Y-pattern 13 and the conductor 2 connects the X-pattern 14 to the Y-pattern 15.

The fitting portions 21*a* and 22*a* of the auxiliary supports 21 and 22 are effective in firmly holding the connection pin 20.

Electrical connections have been made between the X-patterns and the corresponding Y-patterns via the connection pins 20 inserted into the through-holes 11. Therefore, through-holes immediately adjacent to the through-hole 11 into which the connection pin 20 is inserted will be left vacant and no other connection pins will be inserted into them. For this reason, the auxiliary supports 21 and 22 are provided in alignment with through-holes 11 which extend through the same X-pattern and are adjacent to the through-hole 11 into which the connection pin 20 is inserted. However, through-holes at any locations may be used and an arbitrary number of additional supports may be provided as far as the through-holes extend through the wires of the same X-pattern.

Alternatively, the additional supports may also be provided in the Y-pattern direction or both in the Y-pattern direction and in the X-pattern direction.

Some extra or dummy through-holes should be provided at extreme ends of the matrix board so that extra through-holes for the fitting portions 21*a* and 22*a* are available on both sides of a through-hole into which the connection pin 20 is inserted when a subscriber's line at an extreme end of the matrix board is to be connected to the switching system.

The first to third embodiments have been described with respect to a case where the matrix board is positioned with its surface extending in a horizontal plane. However, the matrix board may actually be oriented in any directions.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A connection pin for electrically connecting a first pattern and a corresponding second pattern of at least one set of patterns formed in a matrix board, the first and second patterns being electrically isolated and crossing one over the other, the connection pin being inserted into a through-hole formed in the matrix board, the through-hole extending through the first and second patterns at an intersection of the first and second patterns, wherein said connection pin comprising:

a first support member, press-fitting into the through-hole;

a second support member, inserted into the through-hole; and an electrical conductor disposed between said first and second support members and securely mounted at a first end thereof to said first support member and at a second end thereof to said second support member, said conductor being resiliently deformed to extend into electrical contact with the first and second patterns when the first support member and the second support member are moved toward each other.

2. The connection pin according to claim 1, wherein said electrical conductor is generally loop-shaped, said electrical conductor includes two sides opposed each other and extending along the through-hole and first and second resiliently deformable portions via which the two sides, are continuous with each other, said first end being continuous with the first deformable portion and said second end being continuous with the second deformable portion, said first and second deformable portions being resiliently deformed when the first support member and the second support member are moved toward each other, said first and second deformable portions being deformed so that the two sides move away from each other into electrical contact with the first and second patterns.

3. The connection pin according to claim 1, wherein said first support member and said second support member are spaced apart by a predetermined distance, said first and second support members abut each other when the first and second support members are moved toward each other so that the conductor is prevented from further deforming.

4. The connection pin according to claim 1, wherein there are a plurality of the first patterns and corresponding second patterns, each first pattern crossing over a corresponding second pattern at an intersection where a through-hole extends through the first and second patterns;

wherein said connection pin further includes at least one third support member connected to said first support member, said third support member fitting into a through-hole adjacent the through-hole into which the first support member fits.

5. The connection pin according to claim 1, wherein there are a plurality of the sets of patterns, the sets of patterns lying in different planes, and the through-hole extends through the first patterns and second patterns of the plurality of sets of patterns;

wherein said connection pin further includes a plurality of the conductors disposed between said first and second support members and at least one insulating member, the insulating member being disposed between adjacent conductors so that the adjacent conductors are connected at their adjacent end portions to the insulating member.

6. The connection pin according to claim 5, wherein said first support member, said second support member, and said insulating member line up in the through-hole and are spaced apart by a predetermined distance, and when said first and second support members are moved toward each other, said first support member, said second support, member, and said insulating member are forced together so that the gaps between them are eliminated.

* * * * *